US006868563B1

(12) United States Patent
Hutchings et al.

(10) Patent No.: US 6,868,563 B1
(45) Date of Patent: Mar. 22, 2005

(54) SPA-BASED SPEAKER

(75) Inventors: Brent Mark Hutchings, Ramona, CA (US); Angelo Vito Pugliese, Jr., Vista, CA (US)

(73) Assignee: Dimension One Spas, Vista, CA (US)

( * ) Notice: Subject to any disclaimer, the term of this patent is extended or adjusted under 35 U.S.C. 154(b) by 0 days.

(21) Appl. No.: 10/306,704

(22) Filed: Nov. 27, 2002

Related U.S. Application Data

(60) Provisional application No. 60/334,218, filed on Nov. 28, 2001.

(51) Int. Cl.[7] ..... A47K 3/00

(52) U.S. Cl. ..... 4/541.1; 381/334; 381/387

(58) Field of Search ..... 4/494, 541.1, 546; 381/334, 387

(56) References Cited

U.S. PATENT DOCUMENTS

| | | | | |
|---|---|---|---|---|
| 3,585,991 | A | 6/1971 | Balamuth | 4/541.1 X |
| 4,575,882 | A | 3/1986 | Diamond | 4/559 |
| 4,803,733 | A | 2/1989 | Carver et al. | 381/431 X |
| 5,003,610 | A | 3/1991 | Adachi et al. | 381/431 |
| 5,201,896 | A | 4/1993 | Kruszewski | 248/278.1 |
| 5,329,650 | A | 7/1994 | Zaccai et al. | 4/605 |
| 5,369,796 | A | 11/1994 | Kung | 455/344 |
| 5,621,390 | A | 4/1997 | Neal | 4/541.1 X |
| 5,621,927 | A | 4/1997 | Reiss et al. | 4/559 |
| 5,665,141 | A | 9/1997 | Vago | 95/30 |
| D386,187 | S | 11/1997 | Alsabrook, Sr. | D14/224 |
| 5,715,546 | A | 2/1998 | Kvalvik | 4/580 |
| 5,730,409 | A | 3/1998 | Baron et al. | 248/292.12 |
| 5,748,753 | A | 5/1998 | Carver | 381/96 |
| 5,761,753 | A | 6/1998 | Talbert | 4/559 |
| 5,937,074 | A | 8/1999 | Carver | 381/395 |
| 5,978,975 | A | 11/1999 | Asskaryar | 4/661 X |
| 6,166,605 | A | 12/2000 | Carver | 330/297 |
| 6,225,900 | B1 | 5/2001 | Keon et al. | 381/311 X |
| D451,495 | S | 12/2001 | McGurty | D14/224 X |
| 6,523,191 | B2 * | 2/2003 | Lahay et al. | 4/541.1 |
| 6,608,909 | B2 * | 8/2003 | Brady | 381/387 |
| 2001/0024509 | A1 | 9/2001 | Carver | 381/395 |
| 2001/0031060 | A1 | 10/2001 | Carver | 381/345 |
| 2001/0055397 | A1 | 12/2001 | Norris et al. | 381/77 X |
| 2001/0055402 | A1 | 12/2001 | Azima | 381/431 X |
| 2002/0025050 | A1 | 2/2002 | Macey | 4/546 X |
| 2003/0088912 | A1 * | 5/2003 | Lauter et al. | 4/541.1 |

* cited by examiner

*Primary Examiner*—Robert M. Fetsuga
(74) *Attorney, Agent, or Firm*—Fish & Richardson P.C.

(57) ABSTRACT

System and techniques to movably attach speakers to a spa. A system includes a spa, and a speaker coupled with an exterior surface of the spa in proximity to a location where a spa cover resides when on the spa, the speaker being useable in connection with the spa cover without interference between the spa cover and the speaker.

9 Claims, 7 Drawing Sheets

SPA-BASED SPEAKER

CROSS REFERENCE TO RELATED APPLICATIONS

This application claims the benefit of the priority of U.S. Provisional Application Ser. No. 60/334,218, filed Nov. 28, 2001 and entitled "SPA-BASED SPEAKER".

BACKGROUND

The present application describes systems and techniques relating to spa-based speakers.

Traditional spa entertainment systems have used audio systems, including speakers, and sometimes various media devices. Conventional spa speakers are typically embedded in an interior surface wall of a spa. Such conventional spa speakers are nestled into spa cabinetry in a spa. These types of spa speakers can provide directional sound, from various stereo or media player devices, for a user of the spa. However, such conventional spa speakers lack versatility in their use and fail to provide a high quality listening experience.

Traditional spa-based audio systems and media devices have also used car stereos, video cassette recorders (VCRs), or Digital Versatile Discs (DVDs) installed in the side or corner of a spa. Such conventional systems can be exposed to harsh whether and the water environment inside the spa. Thus, traditional spa-based media systems have provided some protection by placing the equipment behind a barrier that can open or close to allow the user to access the equipment to change media, such as Compact Discs (CDs) and Tapes.

SUMMARY

The present application includes systems and techniques relating to spa-based speakers that are movably attached to a spa. According to an aspect, a system includes a spa, and a speaker coupled with an exterior surface of the spa in proximity to a location where a spa cover resides when on the spa, the speaker being useable in connection with the spa cover without interference between the spa cover and the speaker.

Details of one or more embodiments are set forth in the accompanying drawings and the description below. Other features and advantages may be apparent from the description and drawings, and from the claims.

DRAWING DESCRIPTIONS

These and other aspects will now be described in detail with reference to the following drawings.

FIG. 1 is a sectional view of an example free-standing spa including a subwoofer.

FIG. 2 a sectional view of an example free-standing spa including a moveable speaker attached to an exterior surface of the free-standing spa.

Like reference symbols in the various drawings indicate like elements.

DETAILED DESCRIPTION

The systems and techniques described here relate to spa-based speakers that are movably attached to a spa. As used herein, the term "spa" means a tub used for relaxation, invigoration or health, and includes a device for moving water in the tub; the term "spa" includes free-standing spas, swim spas, and spas generally, regardless of size. The present inventors recognized that conventional spa-based speakers were limited to use during normal operation of the spa and failed to provide a high quality listening experience. Accordingly, the inventors developed spa-based speaker systems and techniques to enhance the listening experience and provide versatility of use.

Figure 1:
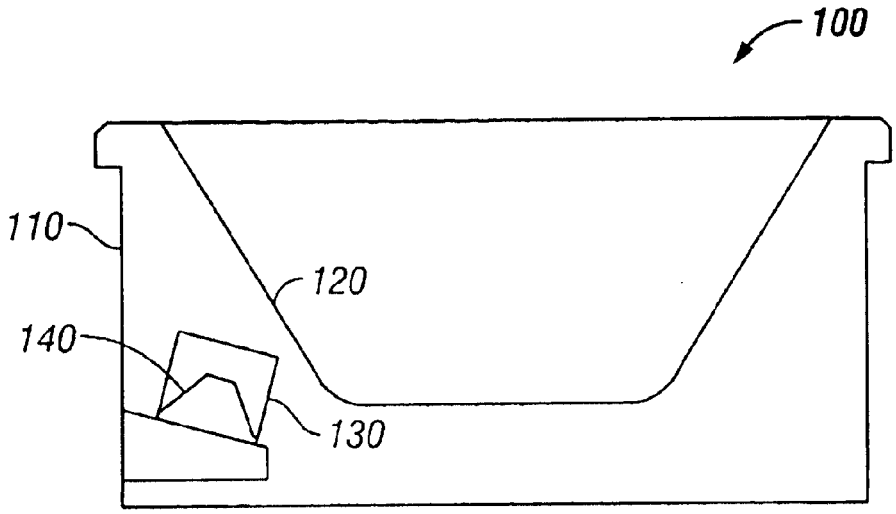

FIG. 1 is a sectional view of an example free-standing spa 100 including a subwoofer 140. The free-standing spa 100 has an exterior surface 110 (e.g., a spa skirt) and a spa shell 120. The exterior surface 110 may be constructed from any suitable material, such as wood, plastic or a laminate material. The spa shell 120 may be constructed from any suitable material, such as fiberglass or plastic. The spa 100 may also include a foam coating on an exterior surface of the spa shell 120 (i.e., between the spa shell 120 and the exterior surface 110). The foam coating may fill the entire space between the spa shell 120 and the exterior surface 110.

A subwoofer 140 is mounted inside the spa 100, between the spa shell 120 and the exterior surface 110. The subwoofer 140 may be mounted inside an enclosure 130. The subwoofer 140 provides low-frequency, non-directional sound to users of the spa; thus extending the overall sound quality by filling in low frequency sounds, which conventional spa sound systems are missing. By using a crossover system, either active or passive, high frequency sound can be filtered out of the signal sent to the subwoofer 140. Thus, the subwoofer 140 can provide low-frequency sound, while satellite speakers, such as described below, can provide high-frequency sound, thereby producing a much higher quality sound experience in the spa than in traditional spa audio systems. The subwoofer 140 may be used simultaneously with the spa to enhance the spa experience. For example, the subwoofer 140 may be positioned to transmit sound waves directly into spa water through the spa shell 120.

Alternatively, the subwoofer 140 may be used while the spa itself is not in use. Additional subwoofers may be included in the spa 100. One or more enclosed spaces and/or openings may be included in the spa 100 and the exterior 110 in order to enhance sound quality.

Figure 2:
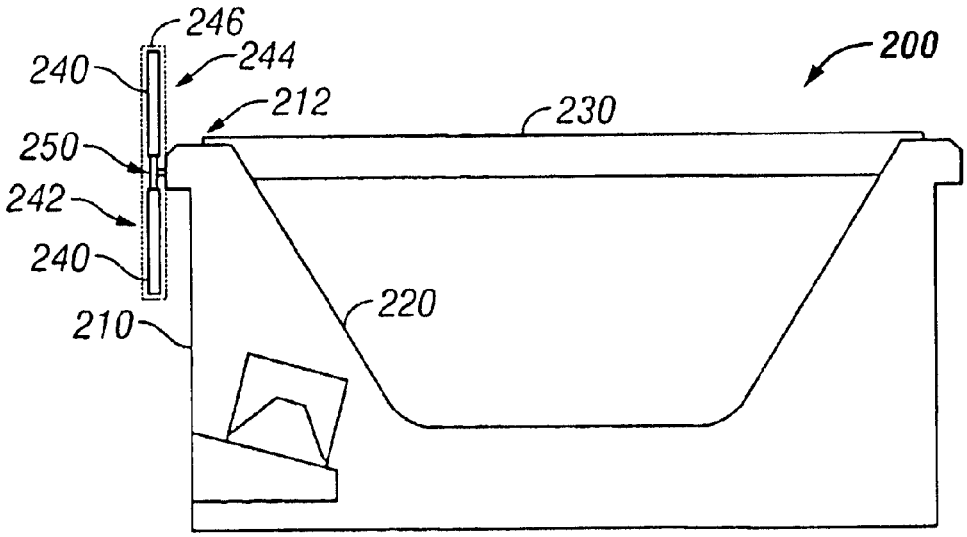

FIG. 2 a sectional view of an example free-standing spa 200 including a moveable speaker 240 attached to an exterior surface 210 of the free-standing spa. The spa 200 includes a spa shell 220 and the exterior surface 210. In addition, the spa 200 is shown with a spa cover 230.

The speaker 240 is attached to the exterior surface 210 in proximity to a location 212 where the spa cover 230 resides when on the spa 200. The speaker 240 is attached to the spa 200 in a moveable fashion using a connector 250, such that it can reside in two or more positions during use. For example, the speaker 240 may be rotatably connected to the exterior surface 210 such that the speaker 240 has a down-position 242 and an up-position 244.

In the up-position 244, the speaker 240 provides a proximate sound source for users of the spa 200. This is similar to conventional spa-based speakers, but without the close proximity of the speaker and the water as in conventional spa-based speakers. Thus, the speaker 240 is removed from the environment inside the spa, and may be used when the spa cover 230 is on the spa 200. In addition, the speaker 240 may be used in the down-position 242, thereby providing a low profile for the spa 200, or the speaker 240 may be moved to the down-position 242 during removal of the spa cover 230. Thus, the speaker 240 is useable in connection with the spa cover 230 without interference between the spa cover 230 and the speaker 240, as illustrated in FIG. 2, and as shown and described below in connection with FIG. 5.

Figure 3:
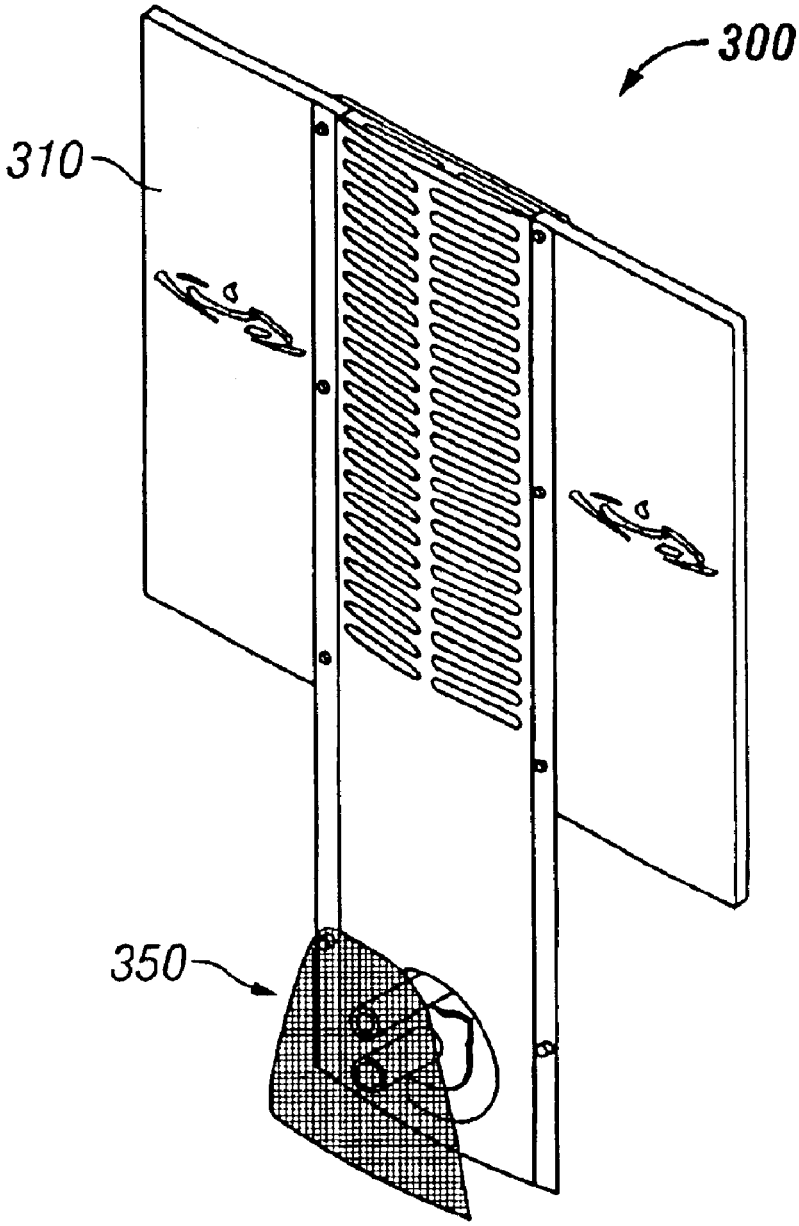
FIGS. 3 and 4 are perspective views of an example planar speaker and connector for use with a free-standing spa.
Figure 4:
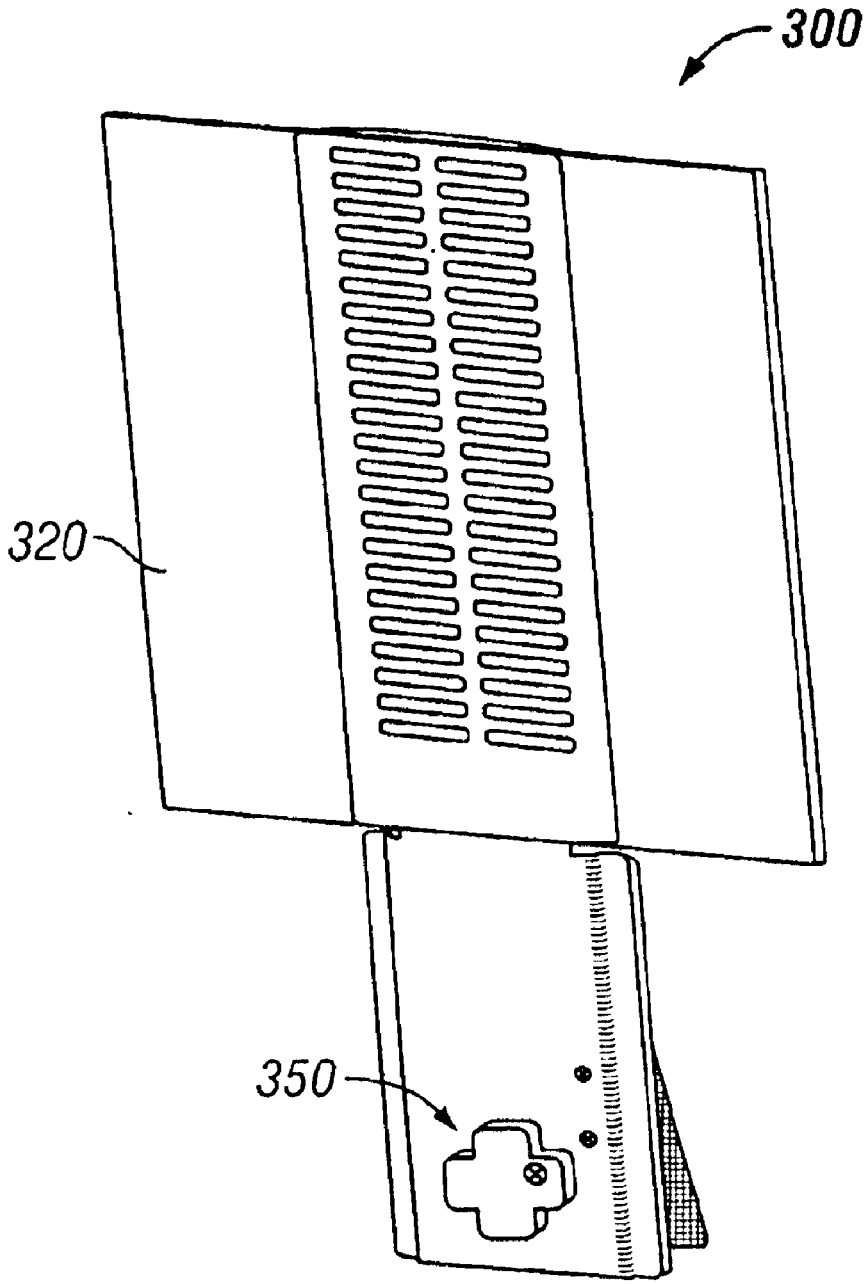

The connector 250 may be a rotational connector with a screw-lock mechanism as shown in FIGS. 3 and 4. This allows the speaker 240 to rotate like the hand of a clock and be placed in any number of positions around a center of rotation. Other connectors are also possible. For example, the connector 250 may be a ball and socket connector, a sliding connector, or a flexible snake-type connector, etc.

When the speaker 240 is rotatably connected to the spa 200, the connector 250 can be a two-piece speaker bracket, the first piece having a receptacle affixed to the spa with screws, nails, adhesives, etc. The receptacle includes a hole (e.g., a standard ¼" female audio jack) wired to an audio system. The second piece of the speaker bracket can be a support to which the speaker 240 is attached, or the speaker bracket can be an integral part of the speaker 240.

The support includes a protrusion (e.g., a standard ¼" male audio plug) that fits into the hole on the receptacle. The protrusion can serve as the pivot point of the rotatably attached speaker, allowing the support to pivot relative to the receptacle. The receptacle can also include two female tabs with detents, and the support can have corresponding male tabs with buttons; thus, when the support is rotated, the buttons on the male tabs engage the detents on the female tabs, thereby fixing the support and speaker in place relative to the receptacle. This design can improve accuracy of positioning the speaker and also make the speaker easily detachable. For additional details regarding this example design for the connector 250, see U.S. Provisional Application Ser. No. 60/429,656, filed Nov. 27, 2002 and entitled "SPEAKER BRACKET".

The moveable speaker 240 may be a planar speaker and may be movable between the available playing positions without leaving a planar area 246 proximate to the spa 200. The moveable speaker 240 may be used in conjunction with multiple other such moveable speakers and with one or more spa-based subwoofers, as described above, to provide high-fidelity sound. Moreover, the moveable speaker(s) may be connected to other furniture, enclosures or spa equipment proximate to the spa. The moveable speaker(s) may be coupled with the spa through spa equipment as well.

FIGS. 3 and 4 are perspective views of an example planar speaker 300 and connector 350 for use with a free-standing spa FIG. 3 shows a front side (spa-facing side) 310 of the planar speaker 300. FIG. 4 shows a back side 320 of the planar speaker 300. The planar speaker 300 may provide omni-directional sound (i.e., 360 coverage), providing sound to both users of the spa and persons outside of the spa.

The flat nature of the planar speaker 300 provides additional versatility in mounting the speaker, without creating a protrusion hazard for users of the spa. The planar speaker 300 may be a planar magnetic speaker, such as a NEOPLANAR® speaker, available from American Technology Corporation, located at 13114 Evening Creek Dr. S. San Diego, Calif. 92128. The planar speaker 300 may be attached to a spa using a rotational connector 350.

Figure 5:
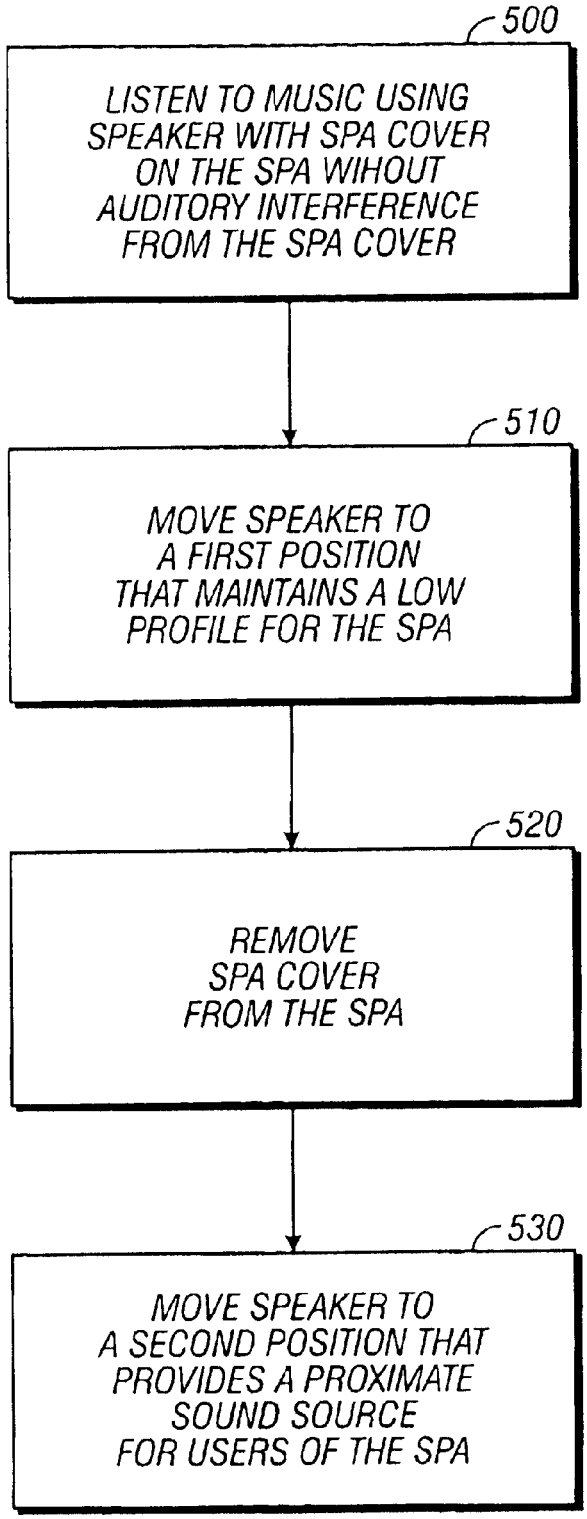
FIG. 5 is a flowchart illustrating an example method of using a spa including a moveable speaker attached to an exterior surface of the spa.

FIG. 5 is a flowchart illustrating an example method of using a spa including a moveable speaker attached to an exterior surface of the spa. A user of the spa listens to music using the speaker with the spa cover on the spa at 500. The spa cover does not cause auditory interference with the music from the speaker due to the nature of the attachment to the spa, such as described above. The speaker may be positioned in multiple manners as desired.

When removing the spa cover, the user of the spa can avoid physical interference between the spa cover and the speaker, and yet still enjoy a proximate sound source in the speaker while in the spa. First, the speaker is moved to a first position that maintains a low profile for the spa at 510. Then, the spa cover is removed at 520. Finally, the speaker is moved to a second position that provides a proximate sound source for users of the spa at 530.

Figure 6:
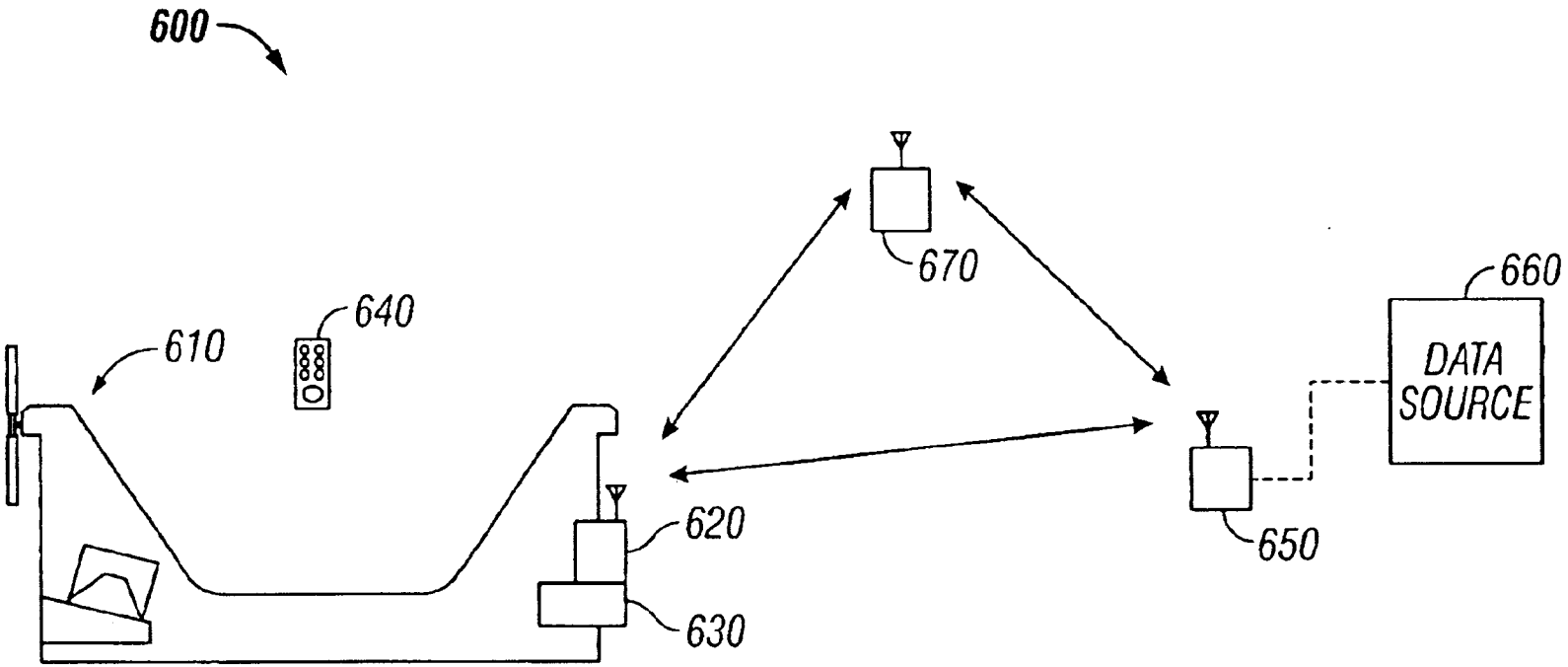
FIG. 6 is a block diagram illustrating an example wireless spa system.

FIG. 6 is a block diagram illustrating an example wireless spa system 600. A spa 610 can have associated speakers, such as a subwoofer and two or more satellite speakers. These speakers can be the movably coupled speakers and subwoofer described above, and these speakers form part of an audio system that can include a transceiver 620, an amplifier 630, and a remote control 640. The remote control 640 can be a programmable, waterproof remote control that wirelessly communicates (e.g., using Infra Red (IR) signals, BlueTooth, etc.) with the transceiver 620 to control both local functions and remote functions for the audio system. The remote control 640 can also be used to control other functions for the spa, such as temperature control, whirlpool, and/or water jet functions.

The transceiver 620 and amplifier 630 can be integrated into a single device; thus, the transceiver 620 can be considered part of both the audio system and the wireless system used to obtain data. The transceiver 620 and/or the amplifier 630 can be inside the spa 610 or in an attached waterproof housing. The amplifier 630 can be a multi-channel audio amplifier (e.g., 3–7 channels) and can contain active adjustable or programmable crossovers on all channels. For example, one channel on the amplifier 630 can be used to power a subwoofer, and the remaining channels can be used for 2–6 satellite speakers. Thus, the audio system can be used to generate surround sound in the spa 610 using a surround sound system, such as Dolby Digital, DTS (Digital Theater Systems, DTS-ES (DTS-Extended Surround), etc.

The audio system can be part of a larger data rendering system. For example, the spa 610 can include a display device, and the data rendering system, which includes the display device and the audio system, can be used to play movies, surf the Web, or enjoy other multi-media entertainment activities while using the spa 610. The data rendering sys tem can also include input devices, such as a digital camera, video camera, microphone, etc., which can be controlled using the remote control 640.

The transceiver 620 wirelessly communicates with a transceiver 650 that is communicably coupled with a data source 660, which may be installed in a house or other desired location. The data source 660 can be computer, a stereo, a walkman, a DVD player, a VCR, a television (TV), a personal computer (PC), a personal digital assistant (PDA), a tablet, and/or a consumer electronic (CE) device, and the data source 660 can be connected to a network (e.g., the Internet). The transceiver 650 can be physically coupled with the data source 660 and/or wirelessly coupled with the data source 660. For example, the transceiver 650 can have a wire-based connection to the data source 660 to receive digital and/or analog data, and also have a wireless connection to the data source 660 (e.g., use IR signals) to send control signals to the data source 660.

The transceiver 650 receives information (e.g., an audio and video signal) from the data source 660 and transmits the information to the transceiver 620, such as via radio frequency (RF) transmissions. The information transmission should be such that it passes through walls or other obstacles to the transceiver 620. The transceiver 650 can also receive control information from the transceiver 620, process the control information and output it to the data source 660, such as by transmitting IR remote control signals to control a device. When greater distances are involved, one or more repeaters 670 can be used to extend the range of the wireless system, handling information transmission in both directions. Such repeaters 670 can be plugged into a power source and/or battery operated.

The transceiver 620 receives the information signals sent by the transceiver 650 and outputs the information for use in a data rendering system in the spa 610. The information signals can include audio, video, or other data types. When the transceiver 620 receives audio data, the transceiver 620 can process and output the audio data as a preamp audio signal that is sent to an audio amplifier installed in or adjacent to the spa 610. The transceiver 620 can also pick up signals from the remote control 640, spa-system data, and/or spa-system commands and transmit the received information to the transceiver 650.

Thus, in addition to providing multi-media entertainment in the spa 610, the wireless spa system 600 can also be used to remotely control spa functions, either from inside the spa 610 or from other locations. The wireless spa system 600 can be used to relay spa-system data to other locations, such as a PC in a nearby house, which allows remote monitoring of the spa. Such remote monitoring can be used to facilitate spa-problem diagnosis and servicing. For example, the remote control 640 can include a service button that connects the system with a customer service representative over the Internet.

The spa system 600 enables local volume control of the speakers separate from a remote audio source. The wireless communication system can provide audio signals from the remote audio source to the audio system, while a volume of the audio system is controlled locally at the spa without affect in a volume indication at the remote audio source. For example, when the transceiver 620 receives remote control signals, these signals can be forwarded to the transceiver 650, except for volume control signals. Volume control signals can be processed locally to control the sound volume of the audio system in the spa 6. This allows the local audio experience to be controlled independently of the data source 660, and this allows the audio system to be used with an audio source that has little or no amplification capabilities.

Moreover, secondary volume controls can be provided. For example, the remote control 640 can have two volume controls: one for the local audio system and one for a remote audio system. Volume control signals for the local audio system are processed locally, and volume control signals for the remote audio system are passed on to the transceiver 650. In this fashion, the spa occupant can have greater control over the spa experience, such as by having independent control over spa-based speakers and house-based speakers.

The spa system 600 can be built to comply with the various government regulations of wireless communications equipment.

Figure 7:
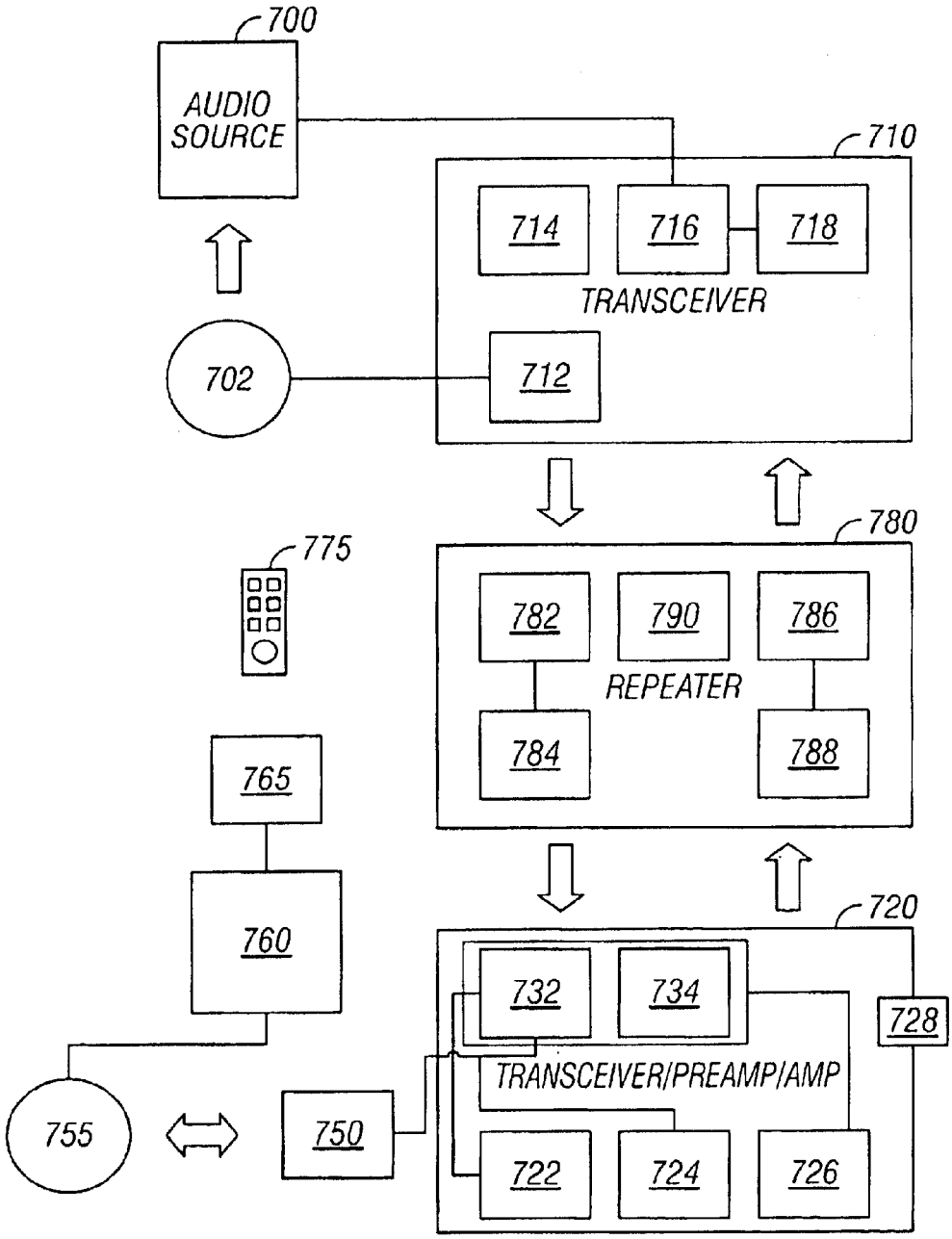
FIG. 7 is a block diagram illustrating example components of a wireless spa audio system.

FIG. 7 is a block diagram illustrating example components of a wireless spa audio system. An audio source 700 can be a home stereo. A plug in IR emitter 702 can be positioned in front of an IR receiver on the audio source 700. A transceiver 710 includes a remote control receiver 712 that receives remote control signals from a transceiver 720 and sends the remote control signals to the IR emitter 702. The audio source 700 outputs audio signals to an audio digital and/or analog input 716 in the transceiver 710.

The transceiver 710 includes a power supply 714 (e.g., a direct current (DC) battery/plug-in), and an audio transmitter 718 to transmit audio information to the transceiver 720, optionally through a repeater 780. The rep eater 780 can be used to relay information between the transceivers 710, 720. The repeater 780 includes an audio receiver 782, an audio transmitter 784, a remote signal receiver 788, a remote signal transmitter 786, and a power source 790.

The transceiver 720 is an integrated transceiver, preamp, and amplifier; although these can be implemented as separate components as well. The transceiver 720 includes an audio receiver 722 connected with a preamp 732. The preamp 732 is integrated with a digital amplifier 734, which can be a 6.1 channels, 50 Watts RMS amplifier with electronic crossover. The transceiver 720 includes a power supply 726 (e.g., 120V/240V) a nd speaker outputs 728.

The transceiver 720 also includes an IR sensor 750 and a remote signal transmitter 724 connected with the preamp 732. Remote control signals (e.g., track change, pause, etc.) are received at the IR sensor 750 and transmitted using the signal transmitter 724. Volume control signals are processed locally and used to control the preamp 732.

The remote control signals can be received at the IR sensor 750 from a remote control 775 directly or from a spa control system 760, which can use a plug in IR emitter 755. The spa control system 760 can also use an IR sensor 765 to pick up spa functions and audio system functions from the remote control 775. Additional input/output devices (e.g., another IR port) can also be provided to create an easily expandable system that can communicate with other devices and systems. Thus, a single remote control in the spa can be used to control multiple independent systems, including a remote data source (e.g., a stereo) and a spa control system to control spa functions.

Figure 8:
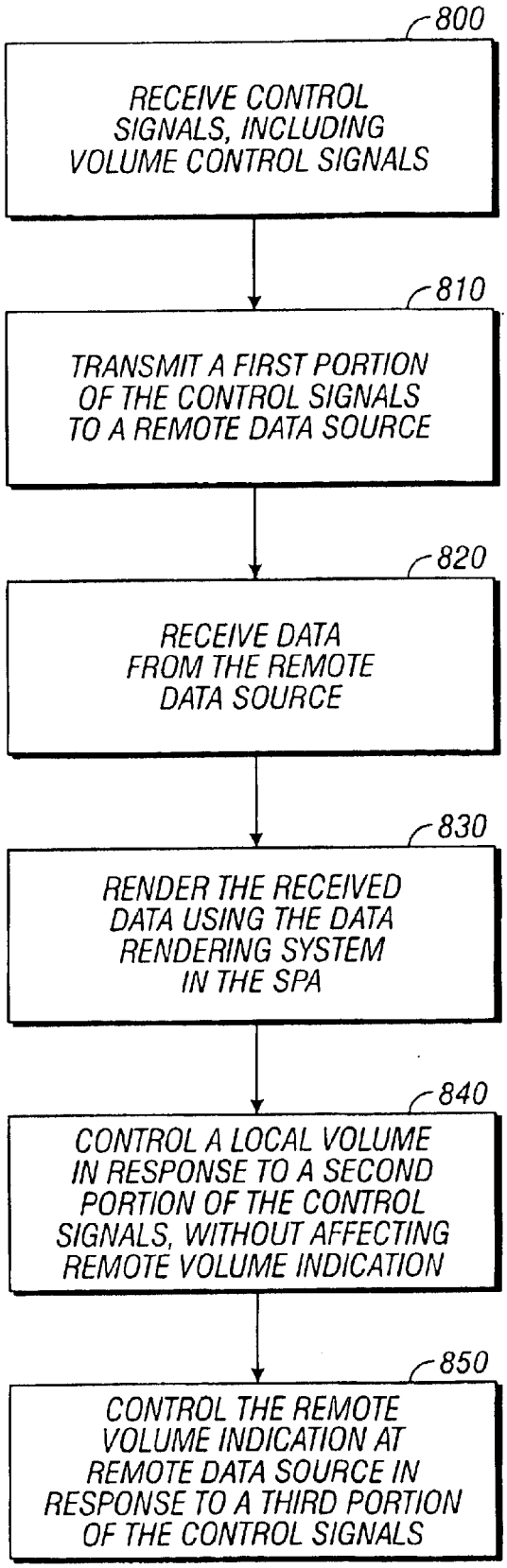
FIG. 8 is a flowchart illustrating an example method of communication in a wireless spa audio system.

FIG. 8 is a flowchart illustrating an example method of communication in a wireless spa audio system. Control signals, including volume control signals, relating to a data rendering system in a spa are received at 800. A first portion of the control signals are transmitted to a remote data source at 810. Data is received from the remote data source at 820. The received data is rendered using the data rendering system in the spa at 830.

A local volume is controlled in response to a second portion of the control signals at 840. This local volume control is performed without affecting a remote volume indication at the remote data source. Moreover, the remote volume indication, which can effect remote volume control, can be controlled at the remote data source in response to a third portion of the control signals at 850.

While various embodiments are shown above and in the accompanying drawings, these embodiments are presented by way of example only. The process flows depicted in FIGS. 5 and 8 do not require the particular order shown, or sequential order, to achieve desirable results. Other embodiments may be within the scope of the following claims.

What is claimed is:

1. A system comprising:

a spa including an exterior surface and a spa shell;

a subwoofer mounted inside an enclosure within the spa between the spa shell and the exterior surface, the subwoofer to provide low-frequency, non-directional sound; and planar speakers movably coupled with the spa to provide omni-directional sound, each of the movably coupled planar speakers having a plurality of available playing positions including at least one position that maintains a low profile for the spa, and each of the movably coupled planar speakers being movable between the available playing positions without leaving a planar area proximate to the spa.

2. The system of claim 1, wherein the plurality of available playing positions include at least one position that provides a proximate sound source for users of the spa while keeping the planar speakers removed from a water environment inside the spa.

3. The system of claim 2, further comprising a surface proximate to the subwoofer and defining in the exterior surface to enhance sound quality.

4. The system of claim 1, wherein the movably coupled planar speakers comprise planar speakers rotatably coupled to the spa.

5. A system comprising:

a spa including a spa shell and an exterior surface of the spa;

a speaker coupled with the exterior surface of the spa in proximity to a location where a spa cover resides when on the spa, the speaker being useable in connection with the spa cover without interference between the spa cover and the speaker, which comprises the speaker being useable when the spa cover is on the spa without auditory interference from the spa cover, and the speaker being moveable from between at least tow positions such that the spa cover can be removed and replaced without physical interference between the spa cover and the speaker;

a subwoofer mounted inside an enclosure within the spa between the spa shell and the exterior surface; and one or more additional speakers coupled with the exterior surface.

6. The system of claim 5, further comprising a surface proximate to the subwoofer and defining an opening in the exterior surface to enhance sound quality.

7. The system of claim 6, wherein the speakers include locking mechanisms to fix positions of the speakers as desired.

8. The system of claim 6, wherein the speakers are rotatably coupled with the exterior surface.

9. The system of claim 6, wherein the speakers comprise planar speakers.

* * * * *